US006409431B1

(12) United States Patent
Lynch

(10) Patent No.: US 6,409,431 B1
(45) Date of Patent: Jun. 25, 2002

(54) SUBMERSIBLE FLOATING DOCK

(76) Inventor: Thomas S. Lynch, 5719 Park Ave., Wilmington, NC (US) 28403

( * ) Notice: Subject to any disclaimer, the term of this patent is extended or adjusted under 35 U.S.C. 154(b) by 0 days.

(21) Appl. No.: 09/506,517

(22) Filed: Feb. 17, 2000

(51) Int. Cl.[7] ..... B63C 1/02; B63B 35/42

(52) U.S. Cl. ..... 405/200; 405/207; 405/219; 405/221; 114/263; 114/54

(58) Field of Search ..... 405/200, 205, 405/207, 219, 221, 218; 114/263, 52, 54, 123

(56) References Cited

U.S. PATENT DOCUMENTS

| | | | | |
|---|---|---|---|---|
| 3,626,447 A | | 12/1971 | Hindlin | 61/46.5 |
| 4,159,692 A | * | 7/1979 | Dye, Jr. | 114/333 |
| 4,509,446 A | * | 4/1985 | Sutton | 114/45 |
| 4,510,877 A | * | 4/1985 | Bloxham | 114/45 |
| 4,838,735 A | | 6/1989 | Warner | 405/220 |
| 4,938,629 A | | 7/1990 | Boudrias | 405/205 |
| 5,106,237 A | | 4/1992 | Meldrum | 405/221 |

* cited by examiner

*Primary Examiner*—Christopher J. Novosad

(57) ABSTRACT

A submersible floating dock which can be sunk beneath the water line in the event of the approach of a violent storm for protection of the dock against wave action, storm surge, and high winds. A dock with a deck supported on hollow floatation chambers is attached to pilings by rings. The rings allow the dock to move up and down in response to changes in the water level. As a storm approaches water is allowed to enter the hollow floatation chambers which are ordinarily filled with air. This causes the dock and deck to sink beneath the water line making it resistent to damage from storm surge, wave action, and high winds. After the storm has passed, pressurized air is introduced into the floatation chambers forcing the water in the floatation chambers out of the chamber. The air increases the buoyancy of the floatation chambers, hence, of the dock so that it rises above the water line for use by an owner after the danger of storm surge, high winds, and waves has passed.

17 Claims, 4 Drawing Sheets

SUBMERSIBLE FLOATING DOCK

FIELD OF THE INVENTION

The present invention relates to floating dock systems that are resistent to wind damage or storm surge commonly associated with intense storm systems, in particular, hurricanes. If it is possible to submerse a dock system as a hurricane or other powerful storm approaches a coastal area, then the dock system will be below the water and not subject to wind damage caused by hurricanes force winds. Moreover, the storm surge and wave action associated with a hurricane or such similar intense storm system will have any, if any, effect on a dock system that is below the water surface at the time the storm surge and storm waves are hitting the coastal area where the dock system is located.

BACKGROUND OF THE INVENTION

In coastal areas throughout the Southeastern United States, private piers and docks are common. Also, small private marinas using floating docks are often a feature associated with a waterfront housing development. Frequently, these types of docks are constructed relatively inexpensively. Wooden docks are attached to vertical wooden pilings sunk in the ground underneath the water. There are several requirements for these types of structures.

First, there must be access from the land to the structure. This ordinarily may be a pivoting walkway located on a bulkhead or on a pier structure that is significantly above the mean high tide level. The pivoting walkway is attached to or rests upon a floating dock. Ordinarily, this floating dock is made of treated wood, which is resistent to rain, salt spray, and so forth. The floating dock ordinarily is supported on hollow barrels or similar structures. These floatation devices may be filled with air or foam. The docks that are floated on these devices are ordinarily attached to wooden pilings, oftentimes by metal rings that extend around the pilings to allow vertical movement for the floating dock as the water rises and falls but secures the dock from floating off on the tide or other currents. This type of dock system works very well under most circumstances and under most weather conditions.

However, the Southeastern coast is particularly subject to hurricanes. Among other notable hurricanes in the last 10 years have been Hurricane Hugo, Hurricane Andrew, Hurricane Fran, and Hurricane Floyd. Many home owners have discovered that while their homes may be secure against the action of the wind and water, their docks and piers are not. A six or eight foot storm surge, common to hurricanes, can lift a floating structure entirely above hence, off the pilings. Once disconnected from the pilings, the floating docks become like a boat or other floatable object that has come loose from its moorings. It is subject to damage from impact against solid fixed objects, and in turn it can damage bulkheads, boats, piers, and whatever structure may be in the way of a floating dock as it is being moved about by wind and wave action during a hurricane.

This result is undesirable for two reasons. First, docks, pilings, and piers are themselves expensive and, if damaged or destroyed in a hurricane, costly to replace. Second, a floating dock that has broken loose from its connection to pilings or to a pier is a dangerous object which is likely to damage boats or other nearby structures, even the home of the owner of the dock.

DESCRIPTION OF RELATED ART

Submersible dock systems have been recognized as desirable for a variety of reasons. In some circumstances, it may be useful to first submerse a dock structure than to raise an object floated onto the dock structure. For example in Hindlin U.S. Pat. No. 3,626,447 a portable dry dock is disclosed which has inflatable pontoons. They are rail guides on the dock. A boat or ship is maneuvered between the markers on the side of the platform, pontoons are inflated which float the platform and raise the vessel on the floating dry dock. Boudrias U.S. Pat. No. 4,938,629 discloses a floatable wharf structure made of concrete modules. The modules have an inner chamber with plugs that are removed to allow water to enter the chamber as air is removed from the chamber by another aperture. The shell is re-floated by reversing the air circulation. Medlrum U.S. Pat. No. 5,106,237 discloses a submersible dock system designed to be submerged to avoid damage from ice. This is a galvanized metal system heavier than the water on which it is placed. It is raised and lowered mechanically, rather than relying on a floatation system to maintain a portion of the system above water. The purpose of this invention is to allow the entire dock system to be submerged to avoid ice related damage to the structure.

Despite these inventions, there still remains a need for a simply constructed and relatively inexpensive apparatus whereby a dock system may be submerged beneath the water in the event of an approaching violent storm system which promises to have damaging wind, damaging wave action, and a large storm surge.

SUMMARY OF THE INVENTION

The current invention is adapted for use with a floating dock supported by floatation chambers. The floatation chambers are hollow. In this invention, each chamber will have at least one valve for introduction or evacuation of air and for introduction or evacuation of water. As pressurized air is added to the chamber, water is forced from the chamber by the incoming air. As air is evacuated from the chamber, water fills the chamber. When all the air is evacuated from the chamber and the chamber is filled with water, then the floatation chamber will provide little, if any, floatation for the floating dock. If necessary, appropriate ballast, added to the dock, means that the combined weight of the dock, of the floatation chamber filled with water, and of the ballast will be greater than the water displaced, hence, the dock will sink. The dock will settle to the bottom but is still connected to pilings. Because the dock is below the water level, changes in the water level from storm surges and waves will have little, if any, effect on the dock.

Thus, an owner of a floating dock having the current system will, as part of hurricane or storm preparation, simply sink his dock below the water level. When the storm has passed and it is safe, air will be reintroduced to the floatation chambers and water evacuated from the chambers. This will increase the buoyancy of the dock to where the water displaced by the dock system weighs more than the dock and the dock will float back above the water level.

Most docks will be sunk, at most, a few days before a storm approaches. Once the storm has passed, the dock will be re-floated. The docks will not be submerged below the water for an extended period of time. Hence, there will be little chance of damage from marine organisms, sea water, or other issues that could arise should the docks be submerged for long periods.

DETAILED DESCRIPTION OF DRAWINGS

Figure 1:
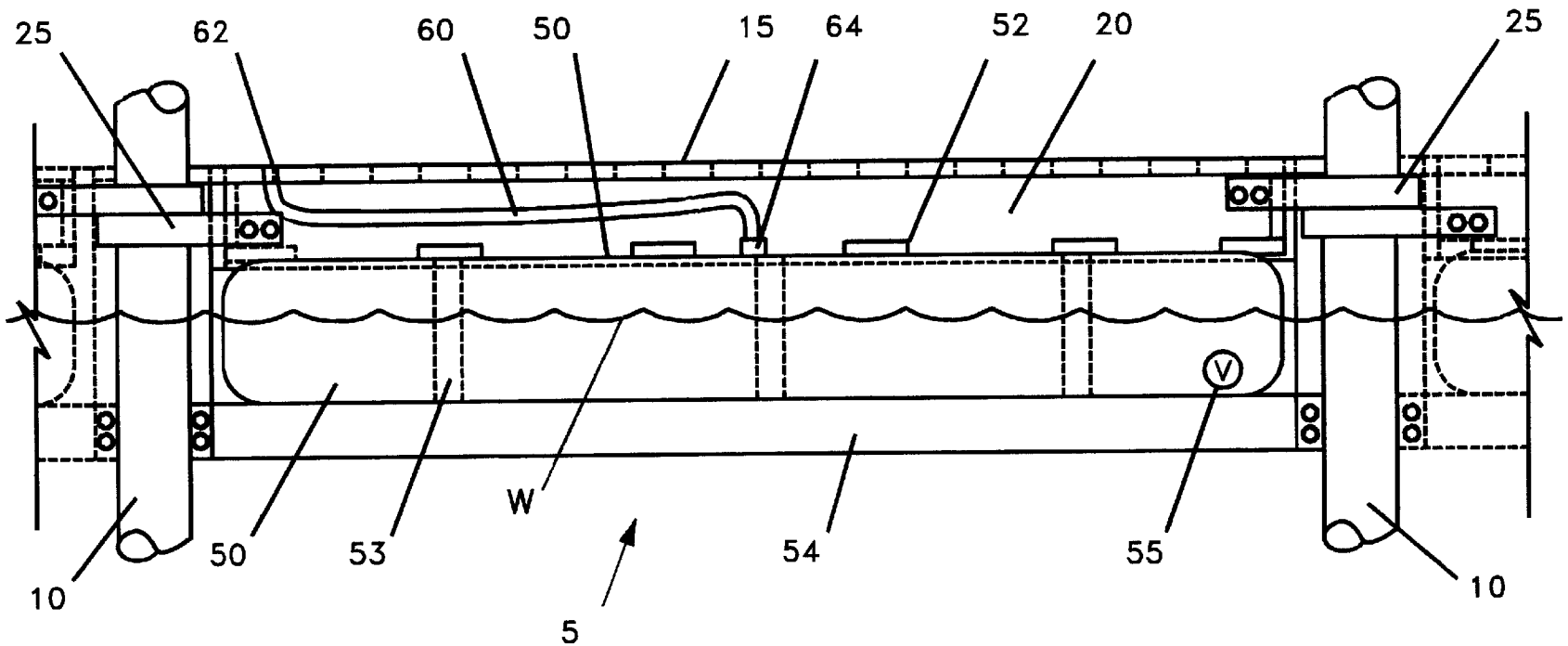
FIG. 1 is a lengthwise cut-a-way view of the current invention.

FIG. 1 shows in lengthwise cross-section a submersible floating dock (5) built in accordance with the current invention. As depicted in FIG. 1, the submersible floating dock (5) forms part of a walkway like might be seen at a marina. For this kind of walkway ordinarily there will be a stairwell or ramp (not shown) connected to a bulkhead which is built significantly above the water level. One end of this walkway rests on the floating dock on rollers. As a floating dock rises and falls with the water, the angle of the walkway from its fixed mounting point on the bulkhead will change to a higher angle as the dock falls as the tide goes out and a smaller angle as the dock rises with the tide. The end of the walkway freely moves on the floating dock on the water. The floating dock (5) will oftentimes be movably attached to pilings (10). In FIG. 1 two pilings are shown, but ordinarily the floating dock (5) will be connected to pilings (10) at all four corners of the floating dock (5), which can be seen more clearly in FIG. 2 (a view from above). The floating dock (5) is usually constructed of treated wood. The surface on which people walk is ordinarily 2×6 wood decking (15). The decking (15) is supported on 2×8 joists (20). At each corner of the floating dock (5) there are rings (25) which encircle the pilings (10). The rings (25) allow the floating dock (5) to rise and fall with the water as the water level changes with the tide, but otherwise secure the floating dock (5) into place. The decking (15) is supported above the water line (W) by a hollow, air and water impermeable floatation chamber (50). The floatation chamber (50) on its upper side rests against 2×8 slats (52) and on its under side by 2×6 skids (54). The skids (54) are connected to the slats (52) by straps (53). The slats (52), skids (54), and straps (53) hold the floatation chamber (50) into place in the floating dock (5). Disposed at the lower end of the floatation chamber (50) is a water valve (55). On an upper surface of the floatation chamber (50) there is an air inlet (64) connected to an air hose (60) which terminates in a quick-release air valve (62).

Compressed air is commonly used to power tools like air hammers, nailers, and the like. Consequently, compressed air sources are readily available in the marketplace. They range from large high-pressure air compressors, which can cost several hundred dollars, to much smaller ones designed to operate off electrical power in a cigarette outlet in a car to be used to fill a flat tire in an emergency. Because of the widespread use of compressed air, valves that allow introduction and evacuation of compressed air are widespread in the marketplace and take a variety of forms. Among others are the valve on a bicycle tire or the quick-release valves found on tools using compressed air, like air hammers. This technology is readily adaptable for use in the present invention for introduction of air into the floatation chamber (50) and evacuation of air from the floatation chamber (50). It is anticipated here that there will be an air inlet (64) located on a top horizontal surface of the floatation chamber (50) which is connected to a flexible air hose (60) which will terminate in a quick-release air valve (62) of the type commonly found on compressed air powered tools. The quick-release air valve (62) allows connection to a compressed air source either directly or by another interconnecting length of air hose. It is anticipated in most applications that a water valve (55) disposed at or near the bottom of the floatation chamber (50) will be sufficient to allow introduction of water into the floatation chamber and evacuation of water from the floatation chamber (50). The water valve (55) will ordinarily always be below the water line (W), even if the floatation chamber is entirely filled with air. Opening the water valve (55) under these circumstances will allow water to enter the floatation chamber (50) and displace air from the floatation chamber (50) if the air valve (62) is open. The floating dock (5) will sink. To refloat the floating dock (5), the air valve (62) is connected to a compressed air source so that the pressure of the compressed air entering the floatation chamber (50) through the hose (60) and air inlet (64) will be sufficient to force the water out of the open water valve (55) entirely filling the floatation chamber with compressed air which will then begin to bubble out of the water valve (55) until it is closed. The description of an air valve (62) and hose (60) connecting to the air inlet (64) at the top of the floatation chamber (50) and a water valve (55) at or near the bottom of the floatation chamber (50) is one of a number of ways of accomplishing introduction and evacuation of air and introduction and evacuation of water from the floatation chamber (50). For example, one need not have a water valve (55) at all, but simply an opening in the floatation chamber (50) at or near the bottom would work in many applications. By the same token, one could use one opening at the top of the floatation chamber (50) for the air valve (62) and for evacuation of the water from the floatation chamber (50) by inserting a siphoning hose through the opening at the top of the floatation chamber (50) to the bottom of the floatation chamber (50). To fill the floatation chamber (50) with water would only be necessary to attach a pressurized water source, like a garden hose, to the water hose leading to the bottom of the floatation chamber (50) and begin the flow of water. In the actual commercial embodiments of this invention the arrangement of the manner of introducing air and water into the floatation chamber (50) and evacuating air and water from the floatation chamber (50) will vary depending on particular applications, the desired convenience of use, the availability of compressed air and water sources close to the dock, the cost of manufacture, and the surrounding environment If the floatation chamber (50) for example will sink into a soft muddy bottom, a different arrangement might be necessary than if the floatation chamber (50) will rest on a firm sand or even rocky bottom. In most applications it is believed that a compressed air source with sufficient compressive power to provide compressed air at a compression high enough to force water out of the floatation chamber overcoming the surrounding ambient water pressure is the most economical way of proceeding. However, a water pump to pump water from a floatation chamber or to pump water into a floatation chamber could work equally well. Variations in the precise arrangements of air valves (62) and water valves (55) are permissible to one of ordinary skill in the art without varying the scope of the invention.

It is anticipated this invention will find its widest use with standard treated wood dock constructions. However, virtually any durable construction material of suitable density could be substituted for wood. For example, the dock could be constructed of concrete products, corrosion resistent metals, or combinations of other materials, including concrete and stone products like marble, slate, tile, or the like. Because the floatation chamber (50) provides requisite floatation for the dock, the materials of which the dock itself are constructed need not be of a density less than water. However, treated wood is widely available and docks are easily constructed from treated wood. If treated wood is employed to build the floating dock (5), then denser materials must be employed to act as ballast (80) (shown in FIG. 2).

Figure 2:
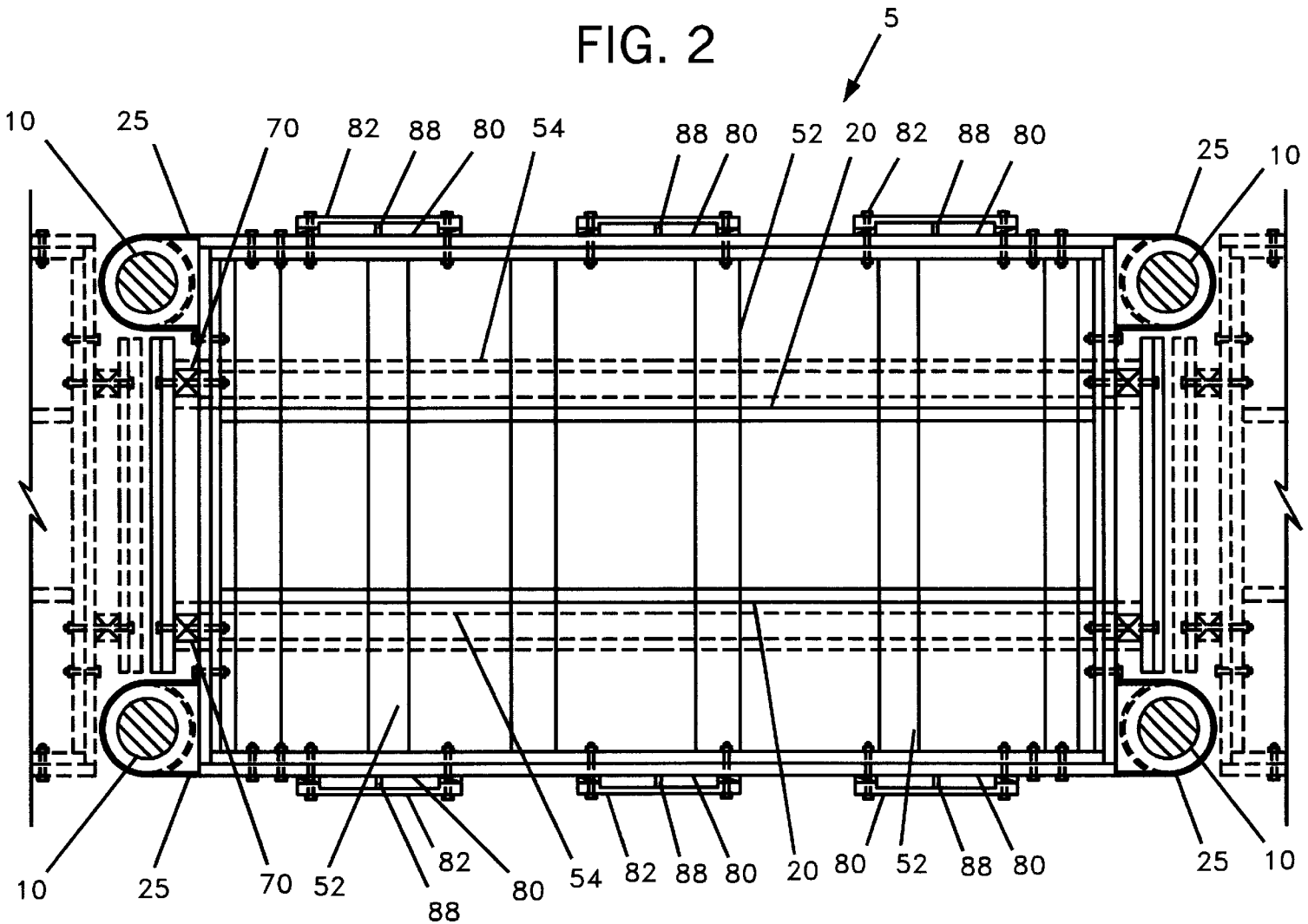
FIG. 2 is the current invention seen from above.

FIG. 2 shows the floating dock (5) from above. In this figure the floating dock (5) is one in a series that together form a walkway. Disposed at each corner are pilings (10). At each end of the floating dock (5) are bumpers (70) constructed simply of wood 2×4's, wood 4×4's, and appropriate connecting bolts. These bumpers (70) project from the ends of the floating dock (5) and closely approach similar bumpers (70) (shown in dotted lines) built on an adjacent floating dock. The bumpers (70) serve a dual purpose of cushioning any lateral movement so that one floating-dock (5) cannot move into an adjacent floating dock damaging the rings (25) or the pilings (10) and provide a convenient stepping point for people who are moving from one floating dock (5) to another. The ballast (80) is shown disposed along the side of the floating dock (5). Because the wood is not as dense as water, even when the floatation chambers (50) are entirely filled with water, the dock may still float above the water line. Therefore, some type of ballast (80) is necessary to increase the overall density of the floating dock (5) so that it will sink. In this embodiment of the floating dock (5) the ballast (80) is placed in pockets (82) built along the side of the floating dock (5). Here, the ballast (80) is a heavy metal plate, preferably some kind of galvanized or treated iron. It will have eye bolts (88) so that the ballast (80) can be easily lifted out and replaced if necessary. However, virtually any kind of ballast would serve as well so long as it was sufficiently dense to assure that the floating dock (5) would sink when the floatation chambers (50) are filled with water. In the event the floating dock (5) was built from a construction material that was denser than water, then ballast (80) would not be required. For example, if the floating dock (5) was made out of formed concrete slabs, then no ballast (80) would be required because concrete is denser than water and would sink when the floatation chambers (50) were filled with water without the need for ballast (80).

Figure 3:
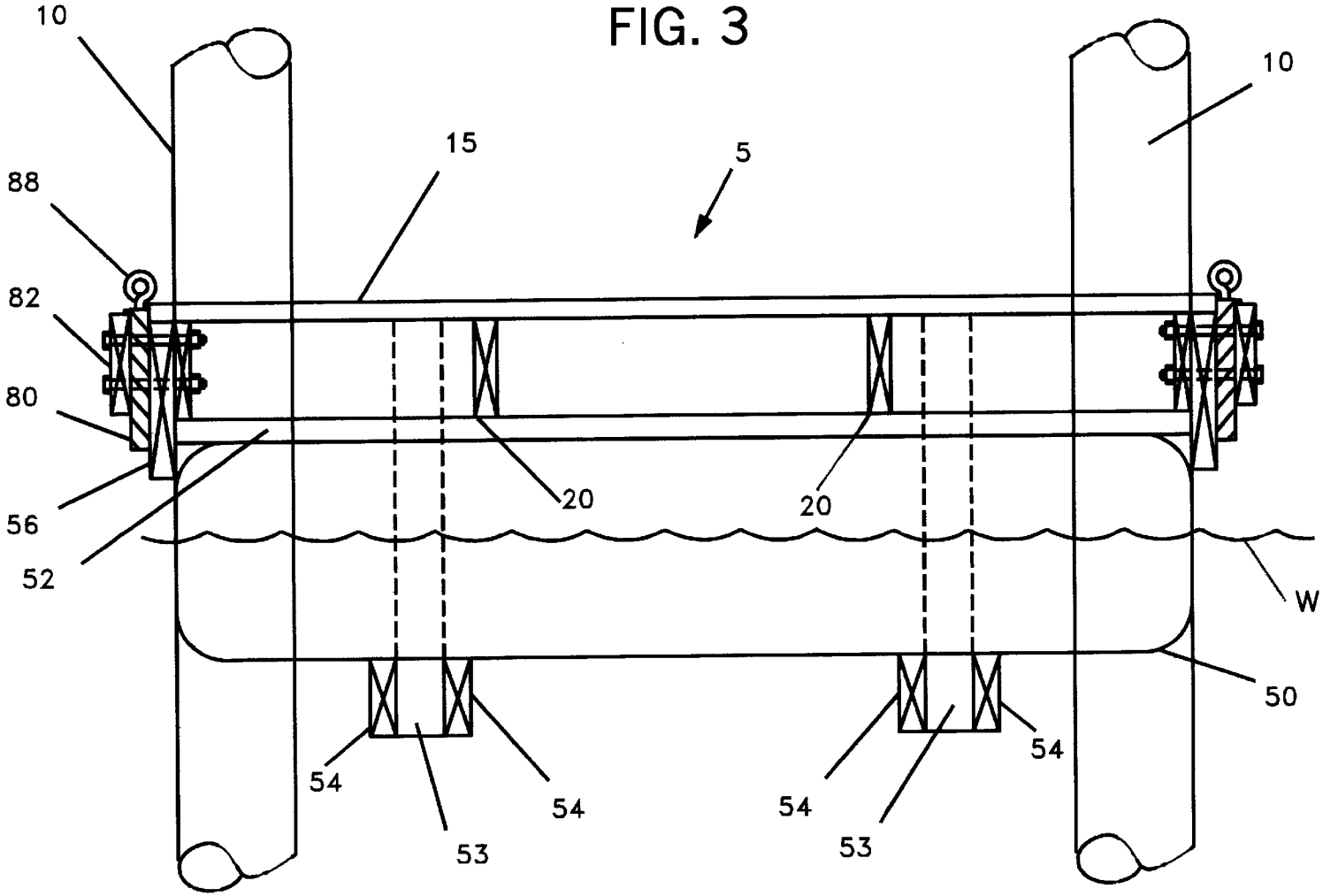
FIG. 3 is a widthwise cut-a-way view of the current invention.

FIG. 3 shows a cut-a-way widthwise view of the current invention. Skids (54) are shown disposed along the bottom of the floatation chamber (50). Straps (53) enclose the ends of the floatation chamber (50) and are connected to the slats (52) and to the decking (15). The decking (15) is supported on joists (20) along the sides of the floating dock (5). There will usually be. an outer band (56) which serves as a place of support for the pockets (82) and the ballast (80). Shown more clearly in this view are the eye bolts (88) at the top of the ballast (80).

Figure 4:
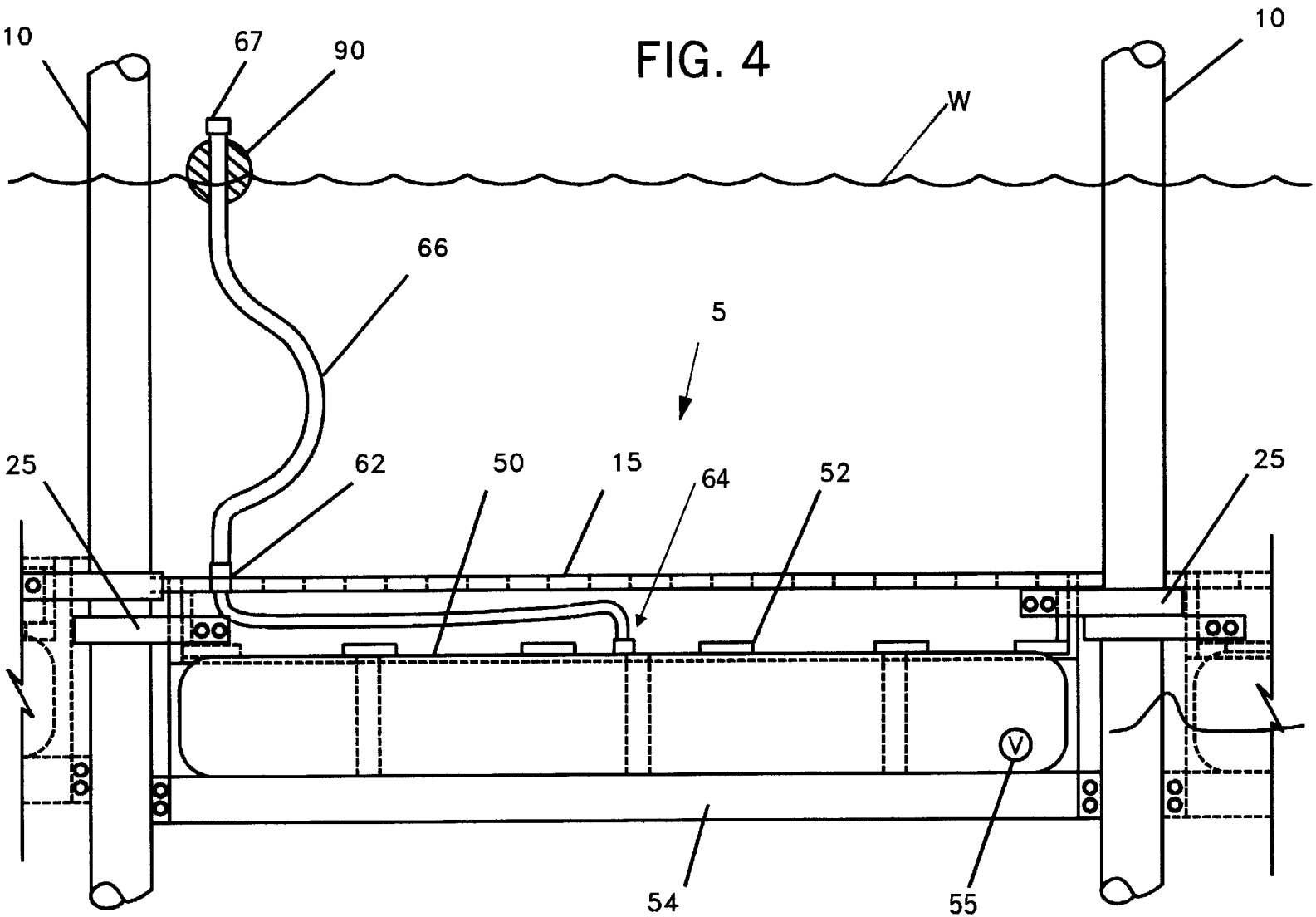
FIG. 4 shows a lengthwise cut-a-way view of the current invention sunk below water level.

FIG. 4 shows the floating dock (5) submersed beneath the water level (W) in a typical application. At each end of the floating dock are the rings (25) connecting the floating dock to the pilings (10). These allow the floating dock (5) to vertically move in response to changes in the water level or to sink when the floatation chamber (50) is filled with water. However, the rings (25) secure the floating dock (5) from horizontal movement that might be caused by water currents or wind. The water valve (55) at the bottom of the floatation chamber (50) has been opened to allow water to enter the chamber. Likewise, the air valve (62) is open and is connected to a second air hose (66) which is attached at one end to a float (90) with a second air valve (67). There is sufficient excess length in the second air hose (66) to allow some play in the float (90). The use of a second air hose (66) with a second air valve (67) attached to a float (90) is simply one way of assuring access to an air valve to fill the floatation chambers (50) once the floating dock (5) is submersed beneath the water. For example, if there is only one floating dock, as might be the case for private docks for a single house, the second air hose (66) could be long enough to reach to and be secured to a nearby bulkhead or other place of easy access for the owner of the floating dock (5) to use the second air valve (67) to fill the floatation chamber (50) to raise the floating dock (5) once the storm has passed. Likewise, the second air valve (67) and the second air hose (66) could be secured to the pilings (10). The use of a float (90) to keep second air hose (66) and second air valve (67) accessible is simply one way of solving this problem and others are equally viable.

In a typical application, the supporting rings (25) will be staggered as is shown in FIG. 4 from one length of a floating dock to an adjacent length of the floating dock attached to the same pilings. As a storm approaches an owner will go to the end of the entire length of the walkway formed of the floating docks, to a particular floating dock (5) open the water valve (55) and open the second air valve (67) so that water will flood the floatation chamber (50) forcing air out of the floating dock air hose (60) through the first air valve (62) through the second length of air hose (66) and out of the second valve (67) connected to the float (90). This will cause the floating dock (5) to slowly sink beneath the water, but the float (90) will assure accessibility to the second valve (67). The owner will move to the next length of floating dock (5) and repeat the process sinking each piece of floating dock (5) as the owner approaches the inclined stairway leading to the bulkhead. Once the last piece of floating dock (5) starts the submerging process, the owner will simply go up the walkway to his bulkhead while watching the floating docks (5) sink beneath the waves. After the storm is over, the owner will return, attach an air hose to the second air valve (67), connected to the float (90), and begin a flow of pressurized air into the floatation chamber (50). The air will force the water inside the floatation chamber (50) outside the open water valve (55) raising the first floating dock (5). When it is raised a sufficient amount, the owner will close the water valve (55) and go to the next float (90) connected to the next piece of floating dock and repeat the process. Thus, each length of floating dock (5) will be raised successively in opposite order from the manner in which they were sunk. Once the last section of floating dock (5) is above the water and the water valve (55) is closed, the second air hose (66), and the float (90) with the second air valve (67) can simply be removed and placed into storage until needed again. Maintenance may be required on the floating dock (5), including washing off the metal ballast (80), cleaning off mud or other debris, or the like. However, this kind of maintenance is far superior than trying to find what is left of a floating dock (5) in a marsh or in an adjacent waterway—a sad task many homeowners have to perform after a hurricane has passed.

I claim:

1. A submersible floating dock resistent to damage from water, wave action, and winds caused by at least a gale force storm comprising:

(a) a deck adapted for use by people;

(b) connected to said deck at least one hollow enclosed floatation chamber impermeable to air and water and sufficiently large to buoyantly support said deck in water when said at least one hollow enclosed floatation chamber is filled with air;

(c) in said at least one hollow enclosed floatation chamber at least one aperture, said at least one aperture for introduction of air into said at least one hollow enclosed floatation chamber, said at least one aperture for evacuation of air out of said at least one hollow enclosed floatation chamber, said at least one aperture for introduction of water into said at least one hollow enclosed floatation chamber, and said at least one aperture for discharge of water out of said at least one hollow enclosed floatation chamber;

(d) means for allowing said deck and said at least one hollow enclosed floatation chamber to move in a vertical direction;

(e) means for restraining said deck and said at least one hollow enclosed floatation chamber from moving in a horizontal direction.

2. A submersible floating dock resistant to-damage from water, wave action, and winds caused by at least a gale force storm of claim 1 wherein said floating dock include a means for introducing pressurized air into said at least one hollow enclosed floatation chamber.

3. A submersible floating dock resistent to damage from water, wave action, and winds caused by at least a gale force storm of claim 2 wherein said at least one aperture is connected to an air hose that terminates in an air valve.

4. A submersible floating dock resistent to damage from water, wave action, and winds caused by at least a gale force storm of claim 3 wherein said means for introducing pressurized air is an air compressor pump-fitted for connection to said air valve.

5. A submersible floating dock resistent to damage from water, wave action, and winds caused by at least a gale force storm of claim 4 wherein said at least one aperture includes a closeable valve whereby the direction of water flow into and out of said at least one hollow enclosed floatation chamber through said at least one aperture is controlled by said valve.

6. A submersible floating dock resistent to damage from water, wave action, and winds caused by at least a gale force storm of claim 5 wherein said air hose is of a defined length so that when said at least one hollow enclosed floatation chamber is filled with water, said hose reaches above the water line and said hose may be secured above the water line at a convenient point.

7. A submersible floating dock resistent to damage from water, wave action, and winds caused by at least a gale force storm of claim 6 wherein said deck is constructed of a material whose density is less than the density of water and said deck includes ballast material, said ballast material of a density greater than water whereby when said at least one hollow enclosed floatation chamber is filled with water the overall weight of the deck and at least one hollow enclosed floatation chamber filled with water is greater than the volume of water displaced by said deck and said at least one hollow enclosed floatation chamber whereby said deck and at least one hollow enclosed floatation chamber sinks below a water line.

8. A submersible floating dock resistent to damage from water, wave action, and winds caused by at least a gale force storm of claim 6 wherein said deck is constructed of material whose density is greater than the density of water.

9. A submersible floating dock resistent to damage from water, wave action, and winds caused by at least a gale force storm of claim 7 wherein said means for allowing and said means for restraining are rings connected to said deck, said rings loosely enclosing pilings anchored in ground below a body of water.

10. A method for submersing and floating a dock to make the dock resistent to damage from water, wave action, and winds caused by at least a gale force storm comprising:

(a) fabricating a deck suitable for use by people;

(b) supporting said deck in water by use of at least one hollow enclosed floatation chamber;

(c) introducing water into said at least one hollow enclosed floatation chamber whereby said at least one hollow enclosed floatation chamber and deck sink below the water line as a storm approaches;

(d) introducing air into said at least one hollow enclosed floatation chamber displacing water in said at least one hollow enclosed floatation chamber until said at least one hollow enclosed floatation chamber and deck rise above the water line after a storm has passed;

(e) restraining said deck and said at least one hollow enclosed floatation chamber for movement only in a vertical direction.

11. A method for submersing and floating a dock of claim 10 that further comprises in said introducing air step of connecting an air hose and valve to said at least one hollow enclosed floatation chamber and connecting an air compressor pump to said valve.

12. A method for submersing and floating a dock of claim 11 that further comprises connecting a float to said air hose so that said air hose is supported above the water line even after the step of introducing water into said at least one hollow enclosed floatation chamber.

13. A submersible floating dock resistent to damage from water, wave action, and winds caused by at least a gale force storm comprising:

(a) a deck adapted for use by people;

(b) at least one hollow enclosed floatation chamber attached to a first side of said deck and of a definite size whereby said at least one hollow enclosed floatation chamber can buoyantly support said deck in water when said at least one hollow enclosed floatation chamber is filled with air;

(c) a means for introducing and evacuating air from said at least one hollow enclosed floatation chamber;

(d) a means for introducing and evacuating water from said at least one hollow enclosed floatation chamber;

(e) means for restraining motion of said deck and said at least one hollow enclosed floatation chamber whereby said deck and said at least one hollow enclosed floatation chamber are restrained to move only in a vertical direction.

14. A submersible floating dock resistent to damage from water, wave action, and winds caused by at least a gale force storm of claim 13 wherein said air means and said water means includes at least one aperture in said at least one hollow enclosed floatation chamber.

15. A submersible floating dock resistent to damage from water, wave action, and winds caused by at least a-gale force storm of claim 14 wherein said air means includes an air pump.

16. A submersible floating dock resistent to damage from water, wave action, and winds caused by at least a gale force storm of claim 15 wherein said water means includes a water pump.

17. A submersible floating dock resistent to damage from water, wave action, and winds caused by at least a gale force storm of claim 15 wherein said water means includes a valve that may be opened and closed in said at least one hollow enclosed floatation chamber.

* * * * *